United States Patent [19]

Garcia

[11] Patent Number: 4,642,909

[45] Date of Patent: Feb. 17, 1987

[54] WALL MOUNTED HAIR DRYER HAVING ADJUSTABLE OUTLET WITH MULTIPLE POSITIONS AND DIRECTIONS

[76] Inventor: Roy Garcia, P.O. Box 937, Elsa, Tex. 78543

[21] Appl. No.: 706,135

[22] Filed: Feb. 27, 1985

[51] Int. Cl.[4] ..... F26B 9/06

[52] U.S. Cl. ..... 34/97; 34/229; 219/373; 239/282; 239/587

[58] Field of Search ..... 34/97, 99, 229; 219/373, 379, 380; 239/282, 283, 178, 184, 587

[56] References Cited

U.S. PATENT DOCUMENTS

| | | | |
|---|---|---|---|
| Re. 17,447 | 10/1929 | Ruffio | 34/99 |
| 761,451 | 5/1904 | Cuvelier | 34/97 |
| 1,419,712 | 6/1922 | Bassette | 219/364 |
| 1,594,906 | 8/1926 | Gross | 219/366 |
| 3,076,887 | 2/1963 | Bulow | 219/366 |
| 3,171,428 | 3/1965 | Bozeman | 34/90 |
| 3,418,452 | 12/1968 | Grabner | 219/370 |
| 3,449,838 | 6/1969 | Chancellor, Jr. | 34/233 |
| 3,662,407 | 5/1972 | Colussi | 4/7 |
| 3,878,621 | 4/1975 | Duerre | 34/233 |
| 3,986,272 | 10/1976 | Feierabent | 34/97 |
| 4,360,159 | 11/1982 | Haynes | 239/282 |

*Primary Examiner*—Larry I. Schwartz

*Attorney, Agent, or Firm*—Norman E. Reitz

[57] ABSTRACT

A wall mounted hair dryer has an outlet for dispensing heated air which is movable to multiple positions and in multiple directions. The degrees of movement include translational and rotational degrees of freedom. Translational movements are provided by the outlet itself while an extension tube may be provided to permit additional translational degrees of freedom of movement as well as a rotational degree of movement. The translational degrees of freedom of movement permit the position of the outlet to be proximate the head of the person whose hair is being dried; the rotational degree of freedom of movement permits the selection of the direction in which the heated air is directed. The person whose hair is being dried may accomplish collateral tasks as his hair is being dried.

4 Claims, 8 Drawing Figures

WALL MOUNTED HAIR DRYER HAVING ADJUSTABLE OUTLET WITH MULTIPLE POSITIONS AND DIRECTIONS

This invention relates to a hair dryer to be mounted on a wall, mirror or other surface adjacent to the place of use and, more particularly, relates to a surface mounted hair dryer whose outlet for blowing heated air is adjustible with multiple degrees of freedom.

In the cycles of fashion there has been a trend to the dry or 'blown dry' look and away from the slicked-down, wet look of earlier years. For whatever reason, this fashion has become predominant in hair styles in Western countries. As a consequence, the great preponderance of both men and women use hair dryers to dry and style their hair to give it bouyancy and body. This has led to the manufacture and use of a great variety of types of hand held hair dryers. The pistol grip type is the most common and is exemplified by the illustration in the first Figure in G. Feierabent, "Hair Dryer", U.S. Pat. No. 3,986,272. Other hand held types include the Dry Baby TM Model 1200 hair dryer available from Windmere Products, 4290 Northwest 165 St., Hialeah, Fla. 33014. In use, such hand held types of hair dryers require that the person continuously employ at least one hand in holding the dryer; at times, the person must shift the dryer from hand to hand in order to be able to dry all areas of his or her hair. Such dryers can fairly be described as having no inherent degrees of freedom; their starting positions and all subsequent points of vantage and directions in which they are aimed are determined by the hand, arm and body movements of the person using them.

Existing types of hair dryers also include professional modes which require the person to remain seated and stationary with their head surrounded by a rigid, concave structure. A consumer variation of the stationary professional model comprises a plastic bonnet, flexible hose and portable blower which requires that the bonnet be affixed over the hair of the person and prevents the wearer from appreciable movement while the hair is being dryed. With either the professional or consumer version the person cannot see or simultaneously style the hair since the head is covered. Such driers also do not have any inherent degrees of freedom as either no movement is possible (professional model) or any movement is provided by the person wearing the bonnet (consumer model). Additional examples of dryers which have degrees of freedom supplied oniy by the user include D. E. Colucci, "Personal Hygiene Device", U.S. Pat. No. 3,662,407 and F. V. Grabner, "Electrically Heated Bath Drying Device", U.S. Pat. No. 3,418,452.

Wall mounted dryers have been provided for drying the hands. They have been employed particularly in airports and other public places where the litter of paper towels and the desire to avoid having to restock paper towels makes air drying attractive. The outlets for dispensing heated, blowing air are securely fastened to walls in order to prevent theft. Thus, individuals have lifted or lowered their hands and extended them an appropriate distance to reach the outlet. A single degree of freedom has been featured on certain wall mounted hand dryers in order to accomodate individuals of varying height. For example, in J. G. Bassette, "Drying Machine", U.S. Pat. No. 1,419,712, the discharge nozzle rotates through a vertical arc to alter the direction of the blowing air; the point of origin remains the same. In C. G. Gross, "Electric Dryer", U.S. Pat. No. 1,594,906, a 360° angular degree of freedom is provided for the direction in which the air is blown. The direction is rotated through 360° with a constant fixed angle being maintained with respect to the face of the cabinet. A telescopic (cylindrical) degree of freedom has also been designed into hair dryers which are mounted on a fixed surface. See R. G. Bozeman, "Hair Drying Device", U.S. Pat. No. 3,171,428; see also L. Cuvelier, "Hair Dryer", U.S. Pat. No. 761,451. However, such dryers have not addressed the full range of the needs of a person of arbitrary height who is also trying to engage in other activities while drying his hair. The provision of a single degree of freedom whether rotational, linear or cylindrical, does not provide the flexibility in three dimensions to carry out a multitude of collateral activities such as polishing nails, tying a tie, brushing teeth, reading the paper, styling the hair or like activities. To provide a wall mounted hair dryer having multiple degrees of freedom is a desirable objective.

SUMMARY OF THE INVENTION

A wall mounted hair dryer is provided which has an outlet for dispensing heated air which is moveable to multiple positions and in multiple directions to permit the person whose hair is being dried to accomplish collateral tasks while the hair is being dried. An extension tube may be provided to the outlet to permit additional degrees of freedom. The degrees of movement may include both translational and rotational components. Preferrably, the outlet has two degrees of translational movement to permit the position of the outlet to be proximate the head of the person whose hair is being dried. Additional translational degrees of freedom of movement may be provided by an extension tube. And a rotational degree of freedom may also be provided by an extension tube to permit selection of the direction in which the heated air is to be directed.

BRIEF DESCRIPTION OF THE DRAWINGS

For a more complete understanding of the present invention reference may be had to the accompanying drawings which are incorporated herein by reference and in which.

DESCRIPTION OF THE PREFERRED EMBODIMENTS

Figure 1:
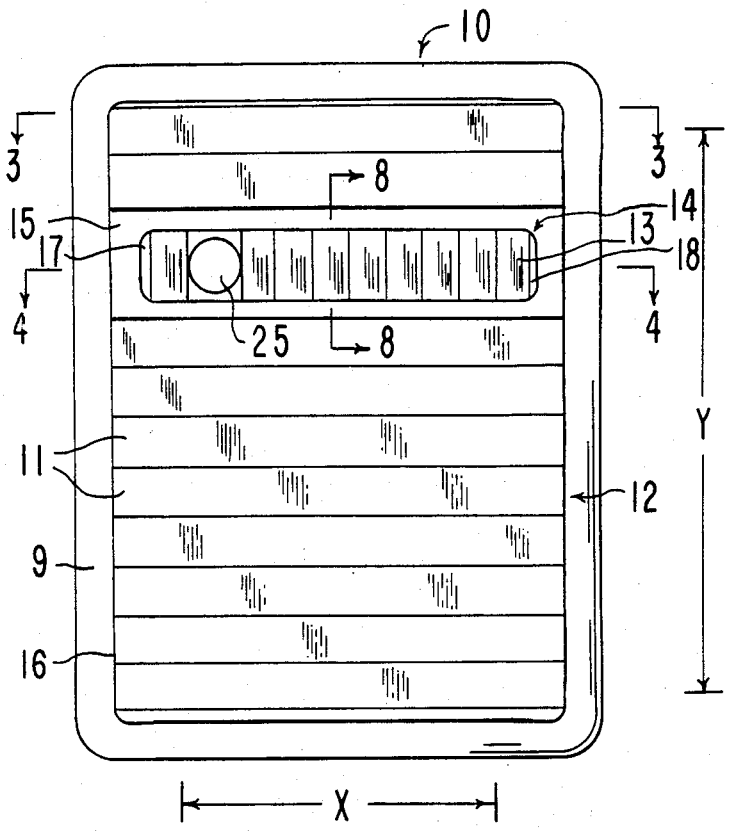
FIG. 1 is a front view of the wall mounted hair dryer without an extension tube in place in the outlet.

A dryer for applying heated air to the hair of a person necessarily has an outlet out of which the heated air flows. This outlet is usually the termination of a blower tube, although it may be an opening in a housing. In either case, the outlet is formed by a solid object such as the blower tube or a housing panel with an opening in it which is defined by surrounding structural features. Such a solid object is known in theory to have six degrees of freedom, i.e. six potential types of movement. Three of these degrees describe translational movement and three of these degrees describe rotational movement. Thus, each of these degrees of freedom describes either a position from which heated air is blown or a direction in which the heated air is blown. Thus, for the outlet of a hair dryer these degrees of freedom or movement provide the versatility for the dryer since they will allow the delivery of heated air to the person at an arbitrary position, within the range of operation of the dryer, and at a direction of choice. This versatility permits the person to simultaneously engage in various activities while he or she is drying their hair. For the outlet, the potential degrees of movement include the three translational degrees of movement and the three rotational degrees of movement. The three translational degrees of movement, x, y and z, may also be designated as horizontal, vertical and depth. The three rotational degrees of movement are rotations about the three principal, mutually orthogonal axes. For a blower tube or circular orifice in the side of a housing a rotation about the cylindrical axis has no physical meaning due to the symmetry. Rotation about either of the other axes will change the direction that the blowing air is directed. Thus, for the present invention of a wall mounted hair dryer having either a circular orifice in a planar housing or a blower extension tube of cylindrical construction there are five possible degrees of freedom or movement. The three translational degrees affect primarily the position from which air is directed. The two rotational degrees affect primarily the direction in which the air is blown. As described above with respect to the prior art, existing hair dryers have only provided a single inherent degree of freedom for the outlet of the dryer; changes in position and direction have been achieved by the manipulation of the person whose hair was being dried.

In a society in which more than 50% of all households have both spouses working outside the home, it is imperative that labor saving devices and time saving practices be included in all areas of daily living. While such devices and practices can be incorporated in most areas of daily living, particularly significant savings can be realized in the area of personal care. Personal care includes grooming and is indispensable to those persons who must leave the home and be presentable to those they encounter in the outside world. Yet it is there very persons who are pressed the most for time since they often must not only work outside the home but must also shop, cook, maintain the household and care for children. It is the aim of the present invention to give such persons precious minutes every day by allowing them to reduce the time spent in personal grooming.

Personal grooming involves clothing selection and care, hair styling and care, and the care of the skin, teeth and hands. Of all these areas the greatest potential for time saving lies in the area of hair care. Both men and women spend many minutes a day in the care of their hair. With the surface mounted hair dryer of the present invention the hands of the person are freed to combine the drying and styling of the hair with other activities such as brushing teeth, clipping nails, tying a necktie, applying makeup, and other activities in the realm of personal grooming. The wall mounted hair dryer of the present invention has an outlet which is adjusted with multiple degrees of movement so as to permit these collateral activities to be carried out while hands-off hair drying is underway. As discussed above, these degrees of movement can be a combination of the three translational degrees of movement and the two rotational degrees of movement. Combinations which include two or more translational degrees of movement are preferred because the position of the outlet is thereby altered for the convenience of the person whose hair is being dried.

Figure 2:
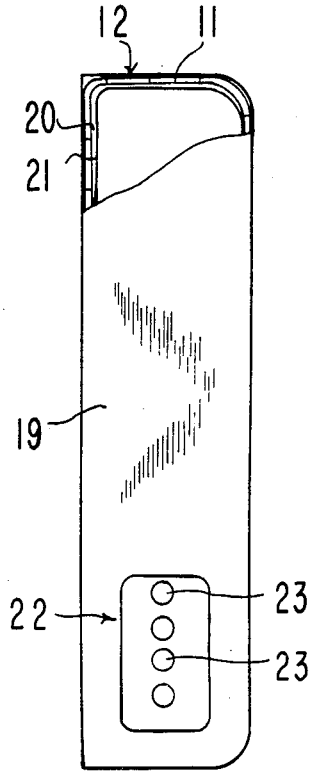
FIG. 2 is a side view of the wall mounted hair dryer, taken from FIG. 1, and broken away to show the first series of interlocked panels.
Figure 3:
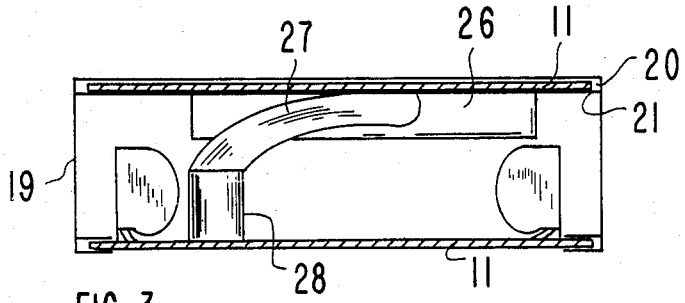
FIG. 3 is a cross sectional view of the wall mounted hair dryer taken through lines 3—3 in FIG. 1.
Figure 4:
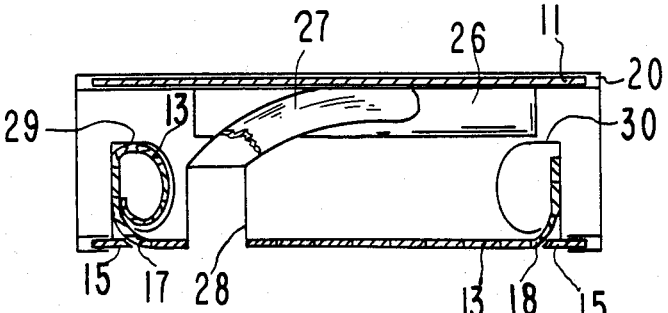
FIG. 4 is a cross sectional view of the wall mounted hair dryer taken through lines 4—4 in FIG. 1.

As seen in FIG. 1, two translational degrees of freedom are provided by the combination of two series of slideable, interlocking panels. The outlet 25 is moveable vertically through the Y distance as a first series 12 of interlocking panels 11 slides up and down within the volume 20 formed within sleeve 21, shown particularly in FIGS. 2–4. The contact between the panels 11 and the edge 16 of the housing of the dryer 10 need not be air tight as the heated air is not circulated through the interior of the housing 9 but rather passes through flexible hose 27 to cylindrical cup 28 which defines outlet 25. The outlet 25 is moveable horizontally through the X distance as a second series 14 of interlocking panels 13 slides left and right into storage containers 29 and 30 shown particularly in FIG. 4. These storage containers are fixed on panel 15 and therefore ride up and down with the series i2 of interlocking panels. Thus, in the embodiment of FIG. 1, the outlet 25 may move over the entire area defined by X times Y.

Figure 6:
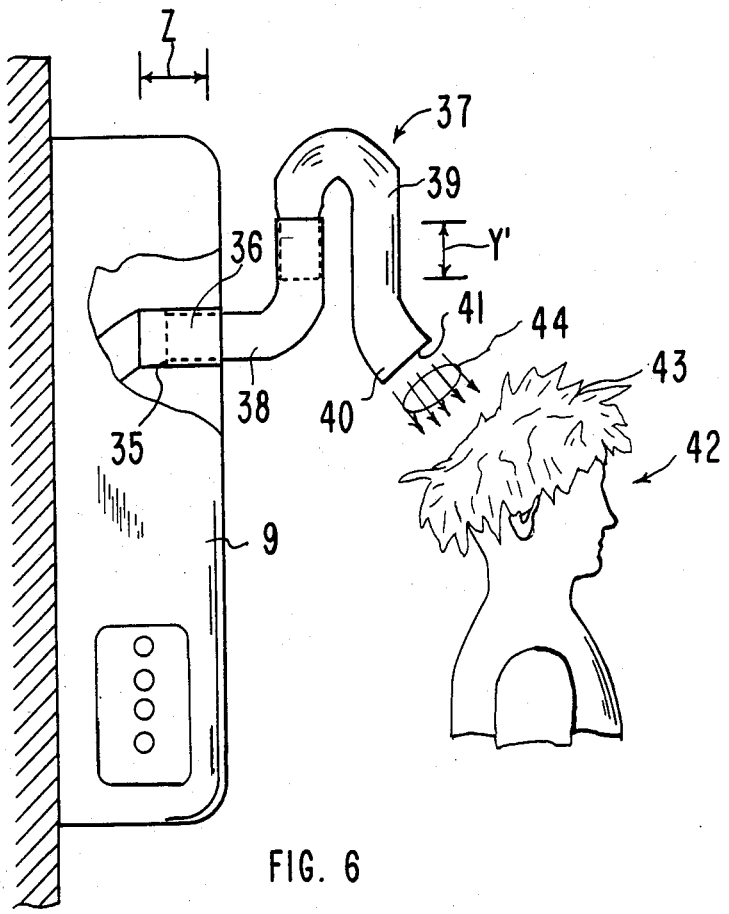
FIG. 6 is a side view of the wall mounted hair dryer as mounted on a wall and broken away to show the variable depth for the extension tube.
Figure 7:
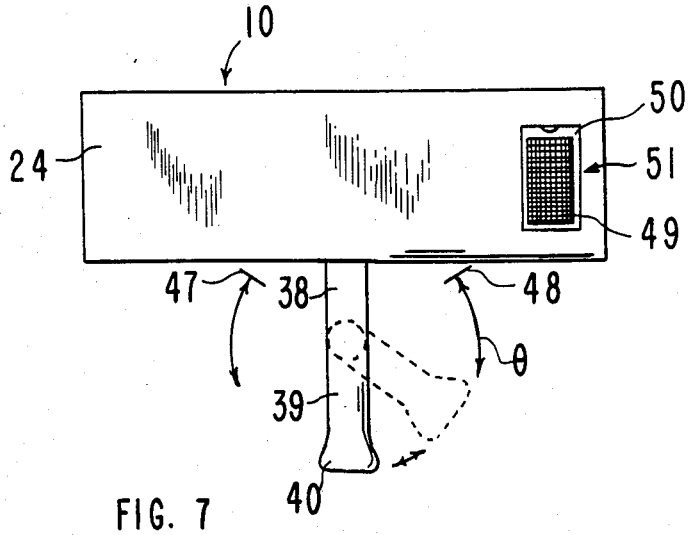
FIG. 7 is a plan view of the wall mounted hair dryer which shows the rotational movement of the exterior portion of the extension tube.

In another embodiment, shown in FIGS. 6 and 7, three degrees of movement are provided by extension tube 37. Extension tube 37 extends from the face of housing 9 and is held in fixed position (for a total of three degrees of movement, as discussed subsequently) or is fitted into the cylindrical cup 28 in the second series of interlocking panels of FIGS. 1–4 (for a total of five degrees of movement). The cylindrical length 36 of extension tube 37 is slideable within the housing 9 over the distance Z so that the working outlet 41 has a depth degree of movement Z. Preferrably, the rear end of cylindrical section 36 has a lip 35 so that the tube 37 cannot be pulled out of the housing 9. A second degree of movement is provided by the telescoping action of outward section 39 within rear section 38. This degree of movement extends over the vertical distance Y′ which is additive to the distance Y, if extension tube 37 is fitted within cup 28; if tube 37 is fixed in place Y′ is the total vertical movement. And, yet another degree of movement is provided by the rotation of outward section 39 within rear section 38 as shown in FIG. 7. The rotation of the outward section 38 through the angle $\theta$ contributes great versatility to the wall mounted hair dryer as the person whose hair is being dried may stand to one side or the other of the precise location of the dryer and still have heated air directed at his or her hair. The boundaries for the angle $\theta$ are determined by the point at which the flared end 40 of outward section 39 contacts the front of either series i2 or 14 of the interlocking panels. These boundaries are shown by the lines 47 and 48 in FIG. 7.

The structure of the wall mounted hair dryer of the present invention may be seen by reference to the Figures. The blower-motor 26 is positioned within the housing 9 against the rear wall so as to not interfere with the traverse of the cylindrical cup 28. The flexible hose 27 is of sufficient length to permit the supply of heated, blowing air from the blower-motor 26 to the cylindrical cup 28 at all points of its X-Y traverse. It is selected for fabrication from materials which are highly flexible yet able to withstand the temperature of the heated, blowing air; Neoprene® is a suitable material. The blower-motor 26 is actuated by pushbutton switches 23 located in the control panel 22 on the side of the housing, as shown particularly in FIG. 2.

Figure 5:
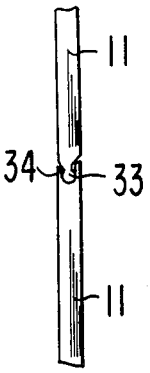
FIG. 5 is a detailed side view of the interconnection seam between adjacent panels in the first series of interlocked panels.
Figure 8:
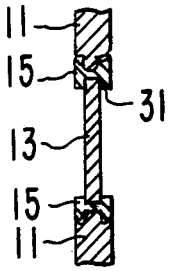
FIG. 8 is a cross sectional view of the second series of interlocked panels taken through line 8—8 in FIG. 1.

The interlocking panels 11 in the first series of panels 12 and the interlocking panels 13 in the second series of interlocking panels 14 are connected together, for example as shown in FIG. 5, by pressing a nubbin 33 in a shaped groove 34. This facilitates the bending of one panel with respect to the adjacent panel as the panels are stored within the sleeves 21 or the storage containers 29 and 30. By comparison of FIG. 1 with FIG. 4 it can be seen that leftmost panel 17 and rightmost panel 18 of the second series 14 of interlocking panels are bent as they enter the storage containers 29 and 30, respectively. Fabrication of the interlocking panels out of flexible plastic materials is preferred in order to facilitate their movement around the corners of the sleeves 21 or into the storage containers 29 and 30. The sleeve 21 has an extension (not shown) which runs along the full length of the open edge i6 of the housing 9 so that the series of panels 11 fit generally flush against the inside surface of the housing 9; however, as stated previously it is not necessary that an air tight fit be obtained since the heated air is communicated directly from the blower-motor 26 to the cylindrical cup 28 via the flexible hose 27 and thence out through the orifice 25 or the end 41 of the extension tube 37. The panels 13 in the second series of interlocking panels 14 ride within the groove 31 formed in the special panel 15, as shown in FIG. 8. This groove 31 extends the length of special panel 15 and terminates near each of its ends so that the panels. in the second series of panels 14 may be forced into and be received back from the storage containers 29 and 30, as shown particularly in the cutaway cross sectional view of FIG. 4.

In operation, the person 42 who is drying his or her hair 43 stands or sits with the head in proximity to the orifice 25 or to the end of the extension tube 37. With the embodiment of FIGS. 1 and 2 the head may be positioned anywhere in the vicinity of the X-Y area of traverse of the orifice 25. With the embodiment of FIGS. 6 and 7 the head may be placed anywhere in proximity to the end 41 of the extension tube 37 which not only may be moved over the X-Y area of traverse but also has the additional height adjustment Y' and the positional variations provided by the rotation through the angle $\theta$. The flared shape to the end 40 of the extension tube 37 provides yet additional volume for region 44 into which the heated air 41 is dispersed. And the rotation through the angle $\theta$ of the outward section 39 of the extension tube 37 permits a wide variation in the direction in which the heated air is blown. The movement of the rear section 38 of the extension tube 37 which occurs as section 35 moves within cylindrical cup 28 adds the depth adjustment Z.

The dryer wil operate trouble free for long periods since it it is not picked up, placed in drawers, dropped or subject to having water splashed on it. Air is introduced into the blower-motor 26 through air intake opening 51, shown in FIG. 7, which exists in the top 24 of the housing 9. The hinged door 50 holds lint screen 49 in place to keep dust particles, hair and lint from entering the blower-motor 26. If lint accumulates on the screen 49, the door 50 is swung open and the lint screen 49 is removed, cleaned and replaced.

Variations in the means to provide the translational movement of the outlet 25 are contemplated. For example, instead of the mutually orthogonal series of interlocking panels 12 and 14, a rod and wire stepping motor assembly as used on X-Y plotters, may be used to move the cup 28 about the face of the housing. And the configuration of the extension tube 37 can be altered. It may be of unitary molded construction with a downward slope or may be divided to permit two persons at a time to dry their hair. Other variations are contemplated within the scope and spirit of the appended claims.

I claim:

1. A wall mounted hair dryer whose outlet is moveable to multiple positions and in multiple directions, comprising:

a housing for mounting on a wall, said housing containing the motor and blower of said hair dryer and including said outlet for blowing heated air;

means for moving said outlet to multiple translational positions on the exterior surface of said housing;

means for changing the direction in which said outlet directs said heated air;

whereby said outlet will blow heated air from multiple positions which are adjustable to be in close proximity to the head of the person whose hair is being dried and in multiple directions which are adjustable to effectively blow dry said hair of said person.

2. A wall mounted hair dryer in accordance with claim 1 wherein said means for moving said outlet in multiple translational directions comprises means to move said outlet in mutually orthogonal translational directions:

3. A wall mounted hair dryer in accordance with claim 1 wherein said translation means comprises:

a first series of panels which are interconnected edge-to-edge such that each panel rotates with respect to the adjacent panel about their interconnecting edge;

said housing having an opening in its front cover and including interior sleeves adjacent opposing ends of said opening whereby the ends of said panels in said first series of interconnecting panels slide into and out of said sleeves as said first series of interconnecting panels traverse said opening;

a second series of panels which are interconnected edge-to-edge such that each panel rotates with respect to the adjacent panel about their interconnecting edge, said second series of panels including a panel which defines said outlet, said second series of panels being mounted on one of said panels in said first series of panels; and panel storage containers for receiving, storing and discharging said panels in said second series of panels, said storage containers being mounted on said one of said panels in said first series of panels whereby said second series of panels may be moved, alternately, towards one side and away from the other side of said one of said panels in said first series of panels as said panels are taken up by one storage container and discharged from the other one of said storage containers, whereby said outlet may be moved from one side of said housing to the other side of said housing.

4. A wall mounted hair dryer in accordance with claim 3 wherein said housing includes sleeve extensions which extend along the inside perimeter of said opening between said sleeves to provide a track for said first series of panels as said first series of panels traverses said opening between said sleeves.

* * * * *